US005291250A

United States Patent [19]

Nishikawa et al.

[11] Patent Number: 5,291,250

[45] Date of Patent: Mar. 1, 1994

[54] LIQUID-TYPE DEVELOPING APPARATUS INCLUDING DEVELOPING HEAD HAVING HERMETIC STRUCTURE

[75] Inventors: Masaji Nishikawa; Atsushi Yagi, both of Tokyo, Japan

[73] Assignee: Olympus Optical Co., Ltd., Tokyo, Japan

[21] Appl. No.: 957,997

[22] Filed: Oct. 8, 1992

[30] Foreign Application Priority Data

Oct. 25, 1991 [JP] Japan ..... 3-280130
Jan. 31, 1992 [JP] Japan ..... 4-16175
May 6, 1992 [JP] Japan ..... 4-113319

[51] Int. Cl.[5] ..... G03G 15/10

[52] U.S. Cl. ..... 355/256; 118/659; 346/1.1; 346/140 R; 354/317; 355/245

[58] Field of Search ..... 355/256, 245; 118/652, 118/659-660; 354/317; 346/111, 140 R

[56] References Cited

U.S. PATENT DOCUMENTS 4,289,092 9/1981 McChesney et al. ..... 354/317 X
4,952,980 8/1990 Sato et al. ..... 355/256
5,016,036 5/1991 Nishikawa ..... 354/317 X

FOREIGN PATENT DOCUMENTS 1-39109 8/1989 Japan .

*Primary Examiner*—Joan H. Pendegrass
*Assistant Examiner*—Shuk Y . Lee
*Attorney, Agent, or Firm*—Frishauf, Holtz, Goodman & Woodward

[57] ABSTRACT

In a liquid-type developing apparatus of this invention, a developing head has a hollow portion having a slit-shaped opening having as a longitudinal direction a direction perpendicular to the convey direction of a recording sheet, and a partitioning wall for dividing the hollow portion into developing liquid flow-in and flow-out chambers and having a top portion located at the slit-shaped opening. A plurality of projecting portions and a plurality of recessed portions for constituting a developing portion are formed on the top portion of the partitioning wall. The plurality of projecting portions and recessed portions are alternately disposed at a predetermined pitch to form stripes in the longitudinal direction of the slit-shaped opening. The direction of the stripes is set to be oblique to the convey direction of the recording sheet. The height of each projecting portion is set to be equal to that of the slit-shaped opening, and the height of each recessed portion is set to be lower than that of the slit-shaped opening.

17 Claims, 14 Drawing Sheets

LIQUID-TYPE DEVELOPING APPARATUS INCLUDING DEVELOPING HEAD HAVING HERMETIC STRUCTURE

BACKGROUND OF THE INVENTION

1. Field of the Invention

The present invention relates to an apparatus for developing, e.g., an electrostatic latent image on a recording sheet by using a developing liquid and, more particularly, to a liquid-type developing apparatus including a developing head having a hermetic structure.

2. Description of the Related Art

Conventionally, a liquid-type developing apparatus of this type has an arrangement as follows. FIG. 19 is a schematic diagram showing the arrangement of an apparatus of this type disclosed by U.S. Pat. No. 4,289,092. This apparatus has a developing head 1, a developing liquid container 3, and a suction pump 5. The developing liquid container 3 is coupled to a developing liquid inlet port 1*i* of the developing head 1 through a pipe 2. The suction pump 5 is coupled to a developing liquid outlet port 1*j* of the developing head 1 through a pipe 4.

The developing head 1 is constituted by lower and upper base bodies 1*a* and 1*b*, as shown in the enlarged view of FIG. 20. The lower and upper base bodies 1*a* and 1*b* respectively form rod-like shapes. The lower and upper base bodies 1*a* and 1*b* are integrated by being bonded to each other. Buffer chambers 1*c* and 1*d* are formed in the developing head 1. The buffer chamber 1*c* communicates with the developing liquid inlet port 1*i*. The buffer chamber 1*d* communicates with the developing liquid outlet port 1*j*. A plurality of partitioning walls 1*e* and 1*f* are alternately formed in the lower and upper base bodies 1*a* and 1*b*, respectively. These partitioning walls 1*e* and 1*f* constitute slit-shaped opening portions 1*h*. The length of the slit-shaped opening portions 1*h* is set to be smaller than the width of a recording sheet on which development is performed. The top portions of the partitioning walls 1*e* and 1*f*, serve as support surfaces of the recording sheet. The height of the top portion of each partitioning wall 1*e* is set to be slightly smaller than that of the top portion of each partitioning wall 1*f*. Gaps formed by the differences between the heights of these top portions serve as the developing liquid feed paths. Reference numeral 1*g* denotes a slit for suction drying.

With the arrangement as described above, an electrostatic latent image formed on the recording sheet is developed in the following manner. That is, the recording sheet having the electrostatic latent image formed thereon is conveyed to the developing head 1 with its surface having the latent image facing downward, and is set at a position to oppose the slit-shaped opening portions 1*h*. In this state, the suction pump 5 is operated. Then, air in the buffer chambers 1*d* and 1*c* of the developing head 1 is discharged by suction through the pipe 4, and the recording sheet is sucked to the slit-shaped opening portions 1*h*. Upon suction of the recording sheet, the entire developing head 1 is set at a negative pressure, and hence the developing liquid is drawn by suction from the developing liquid container 3 through the pipe 2. The buffer chamber 1*c* connected to the developing liquid inlet port 1*i* fills with the developing liquid. The developing liquid flows to the buffer chamber 1*d* connected to the developing liquid outlet port 1*j* through a curved path formed by the partitioning walls 1*e* and 1*f*, and is circulated to the developing liquid container 3 through the pipe 4 and the suction pump 5. In the developing head 1, the developing liquid flows through a gap formed by the difference between the heights of the partitioning walls 1*e* and 1*f*, thereby performing development of the recording sheet. If the partitioning walls 1*e* are formed by a metal, their top portions serve as a developing electrode.

In this conventional developing head, however, the slit-shaped opening portions 1*h* for development form a long member in the widthwise direction of the recording sheet. Thus, when the interior of the developing head is set at the negative pressure, the slit-shaped opening portions 1*h* tend to bend the recording sheet by drawing it into the slits. Then, the recording sheet is flexed, and it becomes difficult to precisely maintain the gap defined between the recording sheet and the top portions of the partitioning walls 1*e*. When the type of the recording sheet is changed, the stiffness of the sheet is changed, and thus the gap described above is changed to vary the developing performance.

In order to prevent this drawback, the difference between the heights of the partitioning walls 1*e* and 1*f* may be decreased to maintain the gap at a small value, or the width of the top portion of each partitioning wall 1*e* may be increased. With this arrangement, however, the in the recording sheet caused by the negative pressure eliminates the gap to disable flow of the developing liquid, and a variation occurs in the flow of the developing liquid to disable normal development. In order to prevent this, a large tension may be applied to the recording sheet, thus preventing the recording sheet from being bent. In this case, however, the convey mechanism for the recording sheet becomes complicated and increased in size. In addition, the recording sheet is unpreferably distorted or damaged.

Published Examined Japanese Patent Application No. 1-39109 discloses another developing head. The structure of this developing head is shown in FIG. 21. A large number of small barriers 22F are disposed in the slit-shaped opening portions in the checker manner. These barriers 22F support the recording sheet and decrease a bend in the recording sheet. Accordingly, the size of the gap is maintained at a substantially constant value, and thus a degradation in developing performance is prevented. With this developing head, however, the large number of complicated barriers 22F or the like must be formed. Thus, the structure of the head becomes very complicated, and its manufacture becomes difficult. In addition, the head becomes considerably expensive.

SUMMARY OF THE INVENTION

It is the first object of the present invention to provide a liquid-type developing apparatus in which a recording sheet is not bent at slit-shaped opening portions of a developing head, thereby always enabling high-quality development regardless of the types of recording sheets.

It is the second object of the present invention to provide a liquid-type developing apparatus capable of performing uniform, variation-free development.

It is the third object of the present invention to make a large, complicated recording sheet convey mechanism unnecessary, thus providing a simple, small, and inexpensive liquid-type developing apparatus.

It is the fourth object of the present invention to provide a liquid-type developing apparatus capable of decreasing a degradation in developing quality near two end portions of a developing head.

It is the fifth object of the present invention to provide a liquid-type developing apparatus, a developing head of which can be manufactured simply and at a low cost.

It is the sixth object of the present invention to provide a liquid-type developing apparatus in which a developing liquid remaining on the developing head when the development is completed is immediately removed, thereby reliably drying the developing portion of the developing head and the surface of the recording sheet.

It is the seventh object of the present invention to provide a liquid-type developing apparatus capable of removing a developing liquid with a simple structure.

It is the eighth object of the present invention to provide a liquid-type developing apparatus capable of stably removing the developing liquid.

In order to achieve the first to third objects described above, in the liquid-type developing apparatus according to the present invention, the developing head comprises a hollow portion having a slit-shaped opening portion extending in a longitudinal direction perpendicular to a convey direction of the recording sheet, and a partitioning wall for dividing the hollow portion into developing liquid flow-in and flow-out chambers and having a top portion located at the slit-shaped opening portion. A plurality of projecting portions and a plurality of recessed portions for constituting the developing portion are formed on the top portion of the partitioning wall. The plurality of projecting portions and recessed portions are alternately disposed at a predetermined pitch to form stripes in the longitudinal direction of the slit-shaped opening portion. The stripes are formed in a direction oblique to the convey direction of the recording sheet. The height of each projecting portion is set to be equal to that of the slit-shaped opening portion, and the height of each recessed portion is set to be lower than that of the slit-shaped opening portion.

As a result, according to the present invention, the following effects can be obtained. That is, the plurality of projecting portions and the plurality of recessed portions are alternately formed in the stripe manner on the top portion of the partitioning wall. Hence, when the recording sheet passes over the slit-shaped opening portion, the recording sheet is supported by the plurality of striped projecting portions and is conveyed stably without being bent. As a result, the size of the gap through which the developing liquid flows can be correctly maintained, thus enabling high-quality development free from non-uniform development. Since the developing portion is constituted by the striped projecting and recessed portions, the developing liquid is stably and reliably supplied to the developing surface of the recording sheet. Hence, a local difference in developing capability at the developing portion is uniform to enable uniform development. In other words, the developing effect can be remarkably improved. A high-precision developing portion can be manufactured comparatively easily. Since a large tension need not be applied to the recording sheet to prevent the recording sheet from being bent, a distortion or damage in the recording sheet can be prevented, and the convey mechanism is prevented from being increased in size and complicated, thus preventing an increase in cost of the apparatus.

In order to achieve the fourth object described above, in the apparatus of the present invention, a plurality of rows of striped recessed and projecting portions comprising the plurality of projecting portions and the plurality of recessed portions are formed on the top portion of the partitioning wall in the convey direction of the recording sheet. With this arrangement, the effective developing area at two end portions of the developing portion is increased, thus decreasing non-uniformity in development at the two side portions of the recording sheet. When the stripes of the plurality of rows of striped projecting and recessed portions are alternately set in different directions in units of rows, the supply direction of the developing liquid to the recording surface of the recording sheet is changed. Thus, non-uniform development on the two side portions of the recording sheet can be decreased, and the developing quality at the central portion of the recording sheet can be improved. The plurality of rows of striped projecting and recessed portions may be set to be alternately offset from each other in the longitudinal direction of the slit-shaped opening portion. Then, further uniform development can be performed.

In order to achieve the fifth object, according to the apparatus of the present invention, the developing head comprises a hollow portion having a slit-shaped opening portion, a partitioning wall for dividing the hollow portion into developing liquid flow-in and flow-out chambers and having a top portion located at the slit-shaped opening portion, and a belt-shaped plate member for constituting the developing portion at the slit-shaped opening portion including at least the top portion of the partitioning wall. A plurality of windows are formed in the belt-shaped plate member at a predetermined pitch to form stripes in the longitudinal direction of the slit-shaped opening portion. The direction of the stripes is set oblique to the convey direction of the recording sheet.

As a result, according to the present invention, the developing head body having the hollow portion and the partitioning wall and the belt-shaped plate member are manufactured separately, and the belt-shaped plate member is mounted on the developing head body in assembling the developing head. For this reason, the developing head can be manufactured simply with high precision when compared to a case wherein, e.g., the slit-shaped projecting and recessed portions are formed by machining the partitioning wall, thereby providing an inexpensive liquid-type developing apparatus.

The belt-shaped plate member formed with the plurality of windows may be bent to have a channel-shaped cross-section, and the channel-shaped belt-shaped plate member may be placed at the top portion of the partitioning wall. With this arrangement, the belt-shaped plate member can be stably fixed with high positional precision with respect to the partitioning wall.

The belt-shaped plate member may be constituted by an elastic member, and engaging portions may be provided to a pair of bent end pieces each formed to have a V shape. When the belt-shaped plate member is to be mounted on the partitioning wall, the engaging portions may be engaged with the side wall portions of the partitioning wall. With this arrangement, the belt-shaped plate member can be easily and stably fixed to the partitioning wall without using screws or an adhesive or without welding. Engaging portions may be formed on the bent end pieces of the belt-shaped plate member, and engagement receiving portions may be formed on the side wall portions of the partitioning wall. When the belt-shaped plate member is to be mounted on the partitioning wall, the engaging portions may be engaged with the engagement receiving portions. With this arrangement, the belt-shaped plate member can be fixed to the partitioning wall more firmly.

In order to achieve the sixth object of the present invention, according to the present invention, there is provided a liquid-type developing apparatus in which a developing liquid container is set to communicate with the developing liquid flow-in chamber of the developing head through a pipe, a suction pump is set to communicate with the developing liquid flow-out chamber of the developing head through a pipe, and the developing liquid contained in the developing liquid container is set to communicate from the developing liquid flow-in chamber of the developing head to the developing liquid flow-out chamber of the developing head through the slit-shaped opening portion. In this apparatus, an outer air valve is connected to the developing liquid flow-in chamber of the developing head through an outer air inlet path. At least the outer air valve is opened at a final step of development on the recording sheet, thereby introducing outer air into the developing liquid flow-in chamber.

Therefore, according to the present invention, when the outer air valve is opened and the suction pump is operated at the final step of development, outer air flows into the developing liquid flow-in and flow-out chambers of the developing head. At this time, the outer air directly flows into the developing liquid flow-in chamber and not via the developing liquid supply pipe and the like. Therefore, the developing liquid fully contained in the developing liquid flow-in and flow-out chambers is pushed out to the suction pump reliably at a high speed to be removed from the interior of the developing liquid flow-in and flow-out chambers. As a result, the developing portion of the developing head and the surface of the recording sheet are reliably dried within a short period of time.

The outer air inlet resistance of the outer air inlet path including the outer air valve is set such that the interiors of the developing liquid flow-in and flow-out chambers of the developing head are set at an appropriate negative value while the suction pump is operative and the outer air valve is open. The outer air inlet resistance is set by appropriately selecting the diameter of, e.g., the outer air inlet path, or by providing the flow control means and adjusting the flow-in amount of the outer air to the developing liquid flow-in chamber. With this arrangement, the operation of removing the developing liquid at the developing portion is stably continued. Thus, when the recording sheet is conveyed in this state, the surface of the recording sheet and the developing portion of the developing head are efficiently dried. As a result, contamination of the recording sheet caused by the remaining developing liquid is prevented, thus performing high-quality development.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

First Embodiment

Figure 1A:
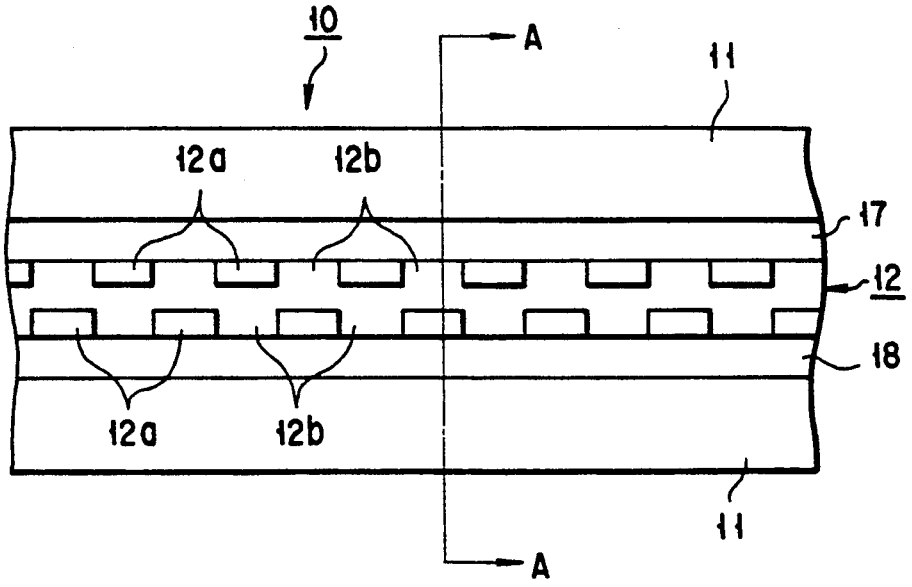
FIGS. 1A and 1B are diagrams showing an arrangement of the main part of a developing head of a liquid-type developing apparatus according to the first embodiment of the present invention.
Figure 1B:
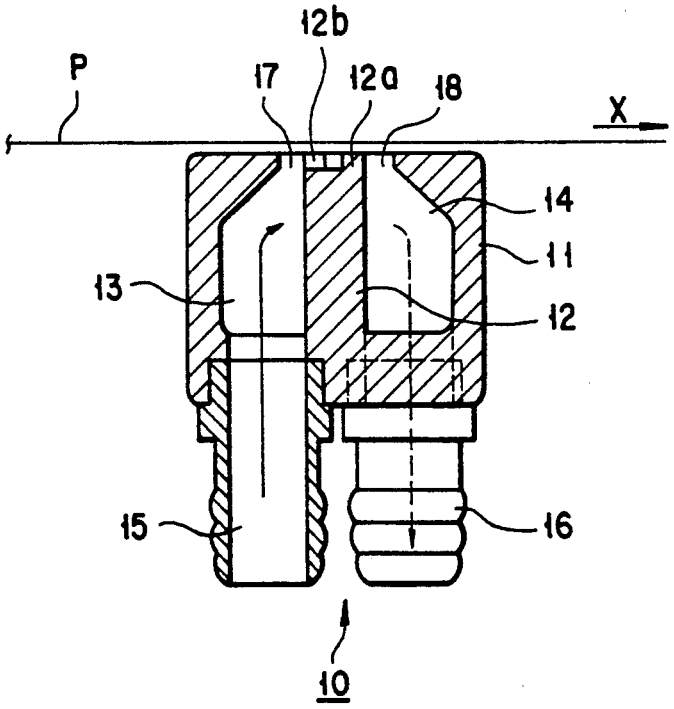

FIGS. 1A and 1B show an arrangement of a liquid-type developing apparatus according to the first embodiment of the present invention, in which FIG. 1A is a plan view of the same, and FIG. 1B is a sectional view taken along the line A—A of FIG. 1A.

A developing head 10 of this embodiment has an elongated rod-shaped base body 11 having a hollow portion. A slit-shaped opening portion is formed in the upper wall of the rod-shaped base body 11 in the longitudinal direction. The length of this slit-shaped opening portion is set to be slightly smaller than the width of a recording sheet P. A partitioning wall 12 forming a ridge is formed in the central portion of the hollow portion of the rod-shaped base body 11. The partitioning wall 12 halves the hollow portion in the feed direction of the recording sheet P. Then, a buffer chamber 13 into which the developing liquid flows and a buffer chamber 14 from which the developing liquid flows are defined in the rod-shaped base body 11. The buffer chamber 13 communicates with a developing liquid inlet port 15, and a developing liquid container is coupled to the developing liquid inlet port 15 through a pipe. The buffer chamber 14 communicates with a developing liquid outlet port 16, and a suction pump (not shown) is coupled to the developing liquid outlet port 16 through a pipe.

A developing portion is formed on the top portion of the partitioning wall 12. The developing portion has a plurality of projecting portions **12*a* and recessed portions 12*b*. The projecting portions 12*a* and recessed portions 12*b* are alternately formed in the checker manner at a predetermined pitch in the longitudinal direction of the partitioning wall 12. The height of the projecting portions 12*a* is set to be equal to the height of the upper wall of the rod-shaped base body 11, and the height of the recessed portions 12*b* is set to be lower than the height of the upper wall of the rod-shaped base body 11 by a predetermined amount. Each projecting portion 12*a* serves as a support surface of the recording sheet P. Each recessed portion 12*b* serves as a flow path through which the developing liquid flows from a slit 17, into which the developing liquid flows to a slit 18, from which the developing liquid flows out. This flow path is designed such that its effective length is equal to or less than several times the width of the top portion of the partitioning wall 12. Then, even if the recessed portions 12*b*** are shallow, the flow path resistance is not largely increased, and a large amount of developing liquid can be efficiently flowed.

With this arrangement, the recording sheet P is developed in the following manner. More specifically, the recording sheet P is conveyed onto the upper surface of the developing head 10 while its surface formed with an electrostatic latent image faces downward. The suction pump is operated in this state. Then, the buffer chamber 14 connected to the developing liquid outlet port is evacuated to be set at a negative pressure, and as a result the recording sheet P is sucked to the slit 18. When the negative pressure near the slit 18 is increased, the recording sheet P is sucked to the slit 17 to seal the slit-shaped opening portion with it. At this time, although the recording sheet P is strongly sucked to the slit-shaped opening portion, since it is uniformly supported by the projecting portions **12*a* formed on the top portion of the partitioning wall 12, the recording sheet P is bent or flexed only slightly. Thus, the gap formed by the recessed portions 12*b* of the partitioning wall 12** is maintained without being closed by the recording sheet P, and thus the flow path of the developing liquid is sufficiently assured.

When the slit-shaped opening portion is sealed, the interior of the buffer chamber 13 is set at the negative pressure. The developing liquid is drawn from the developing liquid container by the operation of the negative pressure, and the interior of the buffer chamber 13 is filled with the developing liquid. This developing liquid flows to the buffer chamber 14 through the flow path defined by the recessed portions **12*b*, and then flows from the buffer chamber 14 into the suction pump through the pipe. In other words, a circulating path of the developing liquid is formed. Under this state, when the suction pump continues to be operated while conveying the recording sheet P in the direction indicated by an arrow X, the electrostatic latent image on the recording sheet P is developed with the developing liquid while the recording sheet P passes over the partitioning wall 12** of the slit-shaped opening portion.

At this time, the recessed portions **12*b* serve as a developing electrode. The function of the developing electrode is enhanced as the gap between the electrode surface and the electrostatic latent image formed surface is decreased. However, the flowability of the developing liquid is improved as the gap is increased. An experimentally confirmed preferable gap size was about 0.3 to 1 mm. If the gap is smaller than this, the flow of the developing liquid is interfered with to make it difficult to flow an amount of developing liquid necessary and sufficient for development, and the developing performance is degraded. In contrast to this, if the gap exceeds 1 mm, the function of the developing electrode is weakened. Moreover, the wall surrounding the projecting portions 12*a*** supporting the recording sheet P will serve as the developing electrode. As a result, sufficiently high developing performance cannot be obtained.

With the developing head 10 of this embodiment, the following effects can be obtained. More specifically, the partitioning wall 12 is provided in the slit-shaped opening portion of the developing head 10, and the projecting portions **12*a* and recessed portions 12*b* are formed on the top portion of the partitioning wall 12 in the checker manner. Hence, the recording sheet P is stably supported on the slit-shaped opening portion without being bent or flexed. Accordingly, the flow path of the developing liquid defined by the recessed portions 12*b*** is reliably assured without being closed by the recording sheet P. As a result, stable, high-quality development can be performed without causing non-uniformity in development. Also, a tension need not be forcibly applied to the recording sheet P, unlike in conventional development. As a result, a distortion of or damage to the recording sheet P is prevented, and the recording sheet convey mechanism is prevented from being increased in size and complicated.

Second Embodiment

Figure 2:
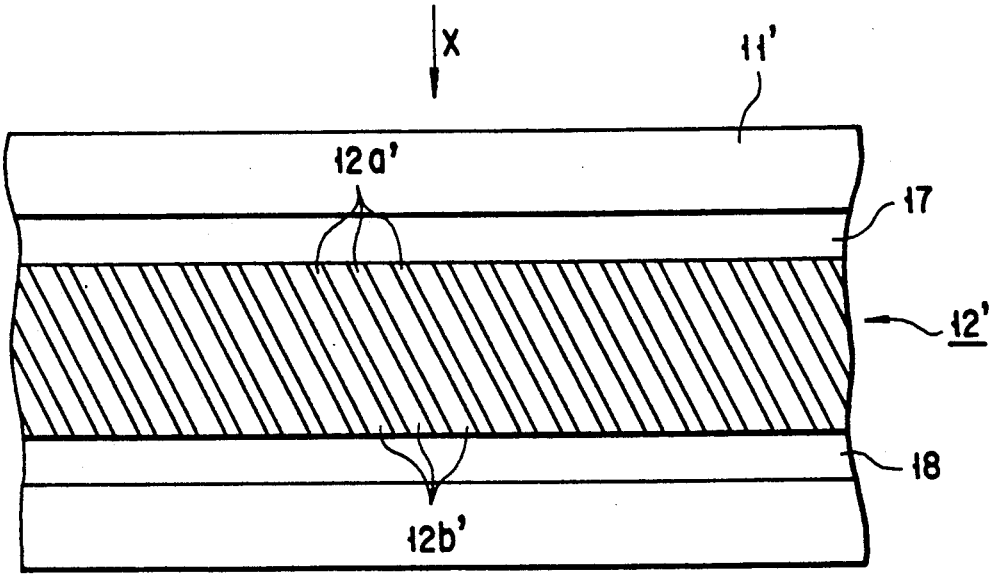
FIG. 2 is a plan view partially showing an arrangement of a developing head according to the second embodiment of the present invention.

Since the developing portion consisting of the checkered pattern of projecting portions and recessed portions, as described above, requires a complicated fabricating process, it is difficult to fabricate. Also, since the developing liquid is difficult to flow smoothly through such a developing portion, the flow path resistance is relatively increased to sometimes cause non-uniformity in development. Therefore, it is preferable that the developing portion has an arrangement as follows. FIG. 2 is a plan view partially showing an arrangement of a developing head according to the second embodiment of the present invention.

Referring to FIG. 2, ridge-shaped projecting portions 12a' and groove-shaped recessed portions 12b' are alternately formed in the stripe manner at a predetermined pitch on a partitioning wall 12'. The projecting portions 12a' and recessed portions 12b' are formed such that they are oblique to a feed direction X of a recording sheet P. The height of the projecting portions 12a' is set to be equal to that of the upper wall of a rod-shaped base body 11', and the height of the recessed portions 12b' is set to be lower than that of the upper wall of the rod-shaped base body 11' by a predetermined amount. Reference numerals 17 and 18 denote slits communicating with buffer chambers 13 and 14, respectively, of the developing head.

With the developing head having the developing portion as described above, the developing operation is performed in the following manner. More specifically, at the developing portion, the developing liquid flows from the buffer chamber 13 to the buffer chamber 14 through the groove-shaped recessed portions 12b'. At this time, since the recessed portions 12b' are linearly formed, the developing liquid flows substantially linearly and smoothly without causing a turbulence. That is, the flow path resistance can be minimized. The recording sheet P is conveyed by a convey mechanism (not shown) while being supported by the ridge-shaped projecting portions 12a'. In this convey process, the recording sheet P is brought into contact with the developing liquid at the developing portion on the partitioning wall 12' to be developed. At this time, the large number of projecting portions 12a' are formed in the entire range of the partitioning wall 12' in the longitudinal direction. Hence, even if the recording sheet P is strongly sucked by the developing head, it is stably supported and conveyed without being bent or flexed. Thus, the flow path of the developing liquid formed by the recessed portions 12b' will not clog. In addition, since the flow path resistance can be decreased considerably, high-quality development can be performed without causing non-uniformity in development.

In the developing head having the arrangement as described above, the width of the partitioning wall 12' that determines the effective developing area is practically set from several mm to 20 mm. If the width is set smaller than the smallest value of the above range, although the flow resistance of the developing liquid is decreased, the developing time is decreased, and thus it is difficult to improve the developing performance. In this case, however, the developing liquid is easy to flow. Thus, if the depth of the grooves of the recessed portions 12b' is decreased, development can be promoted. It is preferable that the angle of inclination of the recessed portions 12b' is increased. Then, all portions of the developing surface of the recording sheet P uniformly oppose the recessed portions 12b' and the projecting portions 12a' while the recording sheet P passes over the top portion of the partitioning wall 12'. As a result, non-uniformity in development is decreased.

In contrast to this, if the width of the top portion of the partitioning wall 12' is set larger than the largest value of the range of several mm to 20 mm, the width of the developing head is increased, resulting in a large developing head. Although the effective developing area is increased, the flow path resistance of the developing liquid is increased. Then, if the depth of the grooves of the recessed portions 12b' is increased to assure the flow amount of the developing liquid, although the function of the developing electrode is decreased, non-uniformity will not easily occur in development even if the angle of inclination of the grooves is decreased.

In this manner, the width of the top portion of the partitioning wall 12' has a specific appropriate range. If the width falls outside this appropriate range, the developing performance is degraded. Similarly, the angles of inclination of the projecting portions 12a' and recessed portions 12b' and the repetitive pitch of the projecting portions 12a' have individual appropriate values. For example, assume that the angles of inclination of the projecting portions 12a' and recessed portions 12b' are set to about −30° to 6.0° with respect to the feed direction X of the recording sheet P, that the repetitive pitch of the projecting portions 12a' is set to 1 to 5 mm in the longitudinal direction of the partitioning wall 12', that the width of the top portion of the partitioning wall 12' serving as the developing portion is set to 5 to 15 mm, and that the depth of the grooves of the recessed portions 12b' is set to about 0.3 to 0.5 mm. Then, a developing head having very high efficiency can be realized.

Third Embodiment

In the developing head having the developing portion formed with the striped projecting portions and recessed portions, as described above, if the angle of inclination of the projecting portions 12a' is set large, the non-uniformity in development is decreased and the developing efficiency is increased. In the developing head of this type, however, if the angle of inclination of the projecting portions 12a' is set large, regions in the two end portions of the developing portion where the developing capability is decreased become large. A length L of each of these regions is increased as the angle of inclination of the stripes is increased.

Figure 4A:
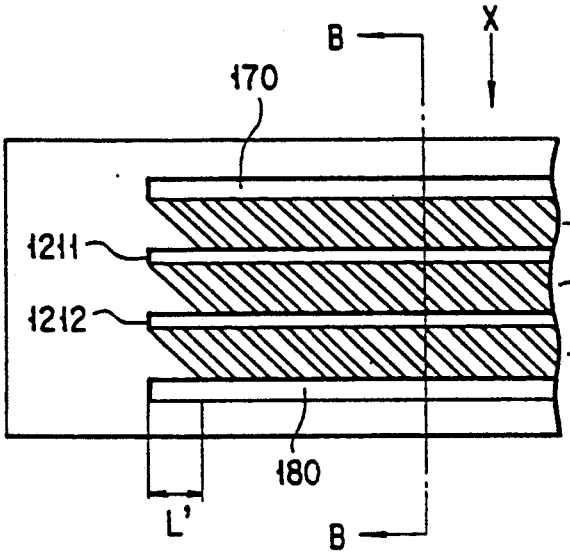
FIGS. 4A and 4B are diagrams partially showing an arrangement of a developing head according to the third embodiment of the present invention.
Figure 4B:
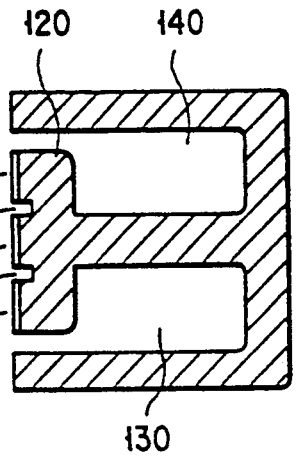

An arrangement for eliminating this drawback will be described below. FIG. 4A is a plan view partially showing a developing portion having this arrangement, and FIG. 4B is a sectional view taken along the line B—B of FIG. 4A. Referring to FIGS. 4A and 4B, a partitioning wall 120 has a T-shaped cross-section. Three rows of striped projecting portion/recessed portion groups 1201 to 1203 are formed on the top portion of the T-shaped partitioning wall 120 in a feed direction X of a recording sheet. These striped projecting portion/recessed portion groups 1201 to 1203 are divided from each other by grooves 1211 and 1212. Slit-shaped opening portions 170 and 180 communicate with a buffer chamber 140 from which the developing liquid flows and a buffer chamber 130 into which the developing liquid flows, respectively.

Figure 3:
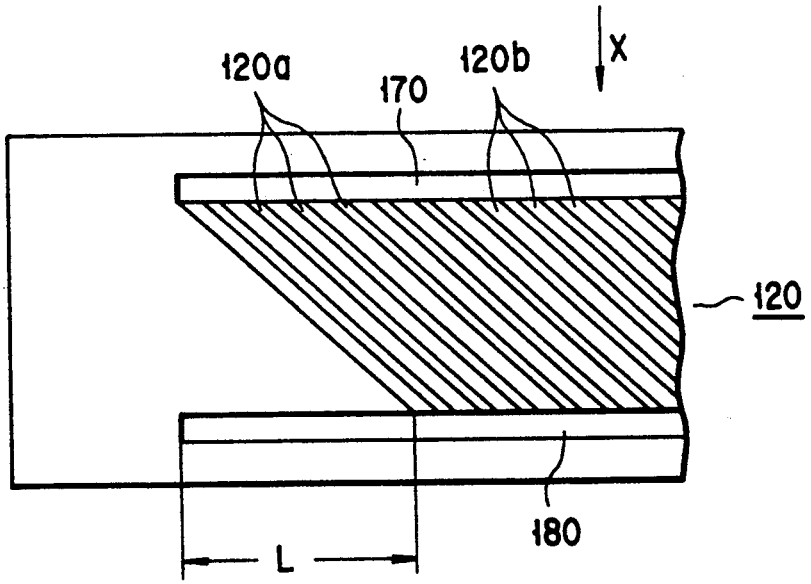
FIG. 3 is a plan view showing an arrangement of an end portion of the developing head.

When the developing portion is designed in this manner, it is equivalent to dividing the striped projecting portions and recessed portions of the developing portion shown in FIGS. 4A and 4B into three portions by the grooves 1211 and 1212 in the feed direction of the recording sheet. Thus, a length L' of each of the regions formed at two end portions of the developing portion where the developing capability is decreased is shortened to about ⅓ that of the developing portion shown in FIG. 3. As a result, the developing capability at the two end portions of the developing portion is improved. This is very effective in putting a high-performance developing head into practice.

Fourth Embodiment

In the developing head having the developing portion formed with the striped projecting portions and recessed portions, as described above, theoretically, the function of the developing liquid extends uniformly to the recording sheet P. When development is actually performed, however, striped non-uniformity in development corresponding to the arrangement pitch of the projecting portions occurs in the developed recording sheet P in the feed direction X of the recording sheet P. This may be because a developing phenomenon stronger than those at other portions occurs at each projecting edge of the front end of the developing portion.

Figure 5:
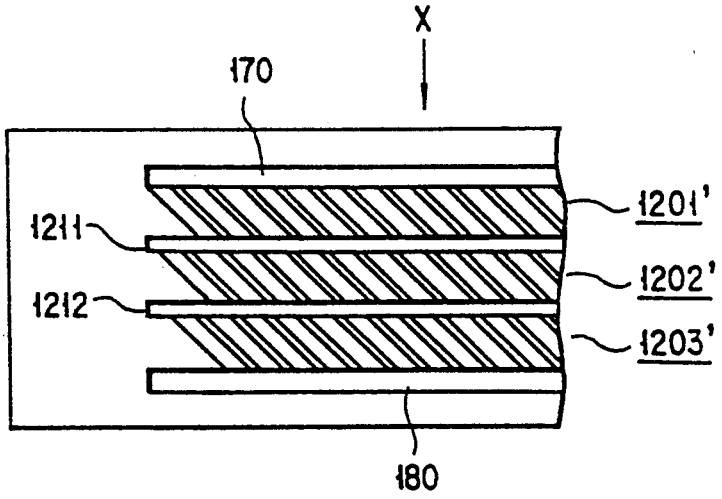
FIG. 5 is a plan view partially showing an arrangement of a developing head according to the fourth embodiment of the present invention.

In order to eliminate these drawbacks, the following arrangement is effective. FIG. 5 is a plan view partially showing a developing portion having this arrangement. As shown in FIG. 5, the projecting portions and recessed portions of respective striped projecting portion/recessed portion groups 1201' to 1203' are formed to be staggered by a ½ pitch in the longitudinal direction of the developing portion. With this arrangement, the pitch of striped non-uniformity in development occurring in the developed recording sheet becomes smaller than that in the arrangement shown in FIG. 3 in accordance with the arranging pitch of the projecting portions and recessed portions. As a result, the striped non-uniformity in development will not be conspicuous, thus improving the developing quality.

In the developing portion, the same direction is set for the respective striped projecting portion/recessed portion groups 1201' to 1203'. However, the stripes may be set in the opposite directions alternately in units of striped projecting portion/recessed portion groups.

Fifth Embodiment

In any of the developing heads described above in the first to fourth embodiments, the developing portion is formed by machining the top portion of the partitioning wall itself by, e.g., cutting. Thus, generally a long period of time is required to manufacture the developing portion. A high-level machining technique is needed to perform machining with high precision.

Figure 6A:
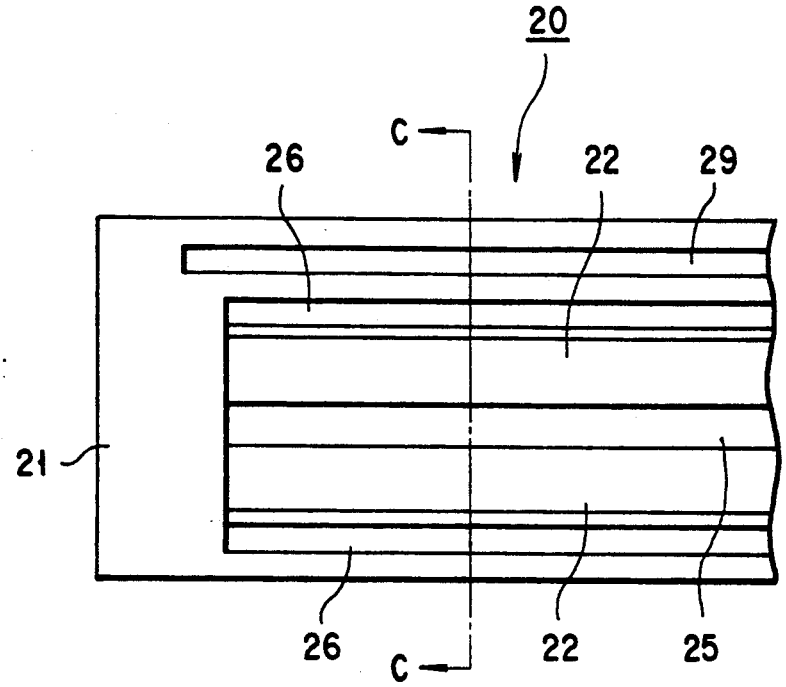
FIGS. 6A and 6B are diagrams showing the main part of an arrangement of a developing head according to the fifth embodiment of the present invention.
Figure 6B:
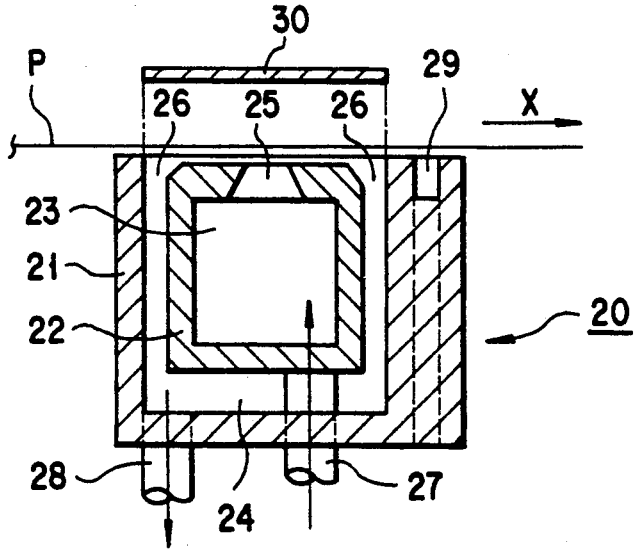

Hence, the fifth embodiment discloses an arrangement of a developing head in which a developing portion can be manufactured within a short period of time with high precision without requiring complicated machining. FIGS. 6A and 6B show the arrangement of the developing head according to the fifth embodiment of the present invention, in which FIG. 6A is a partial plan view of the same, and FIG. 6B is a sectional view taken along the line C—C of FIG. 6A.

A developing head body 20 of this embodiment has an outer tubular body 21 having a rectangular section. An inner tubular body 22 having a rectangular section is housed in the hollow portion of the outer tubular body 21. The inner tubular body 22 serves as a partitioning wall for dividing the hollow portion of the outer tubular body 21 into a buffer chamber 23 into which the developing liquid flows and a buffer chamber 24 from which the developing liquid flows out. Slit-shaped opening portions 25 and 26 are formed in the top portion of the inner tubular body 22 and in the upper surface portion of the outer tubular body 21, respectively. The inner tubular body 22 is housed in the outer tubular body 21 such that its upper surface is slightly lower than the upper surface of the outer tubular body 21. The difference between these heights is set to correspond to at least the thickness of a recording sheet support plate 30 to be described later.

A developing liquid inlet port 27 is formed in the buffer chamber 23. The developing liquid inlet port 27 is coupled to a developing liquid container through a pipe (not shown). A developing liquid outlet port 28 is formed in the buffer chamber 24. The developing liquid outlet port 28 is coupled to a suction pump through a pipe (not shown).

Figure 7:
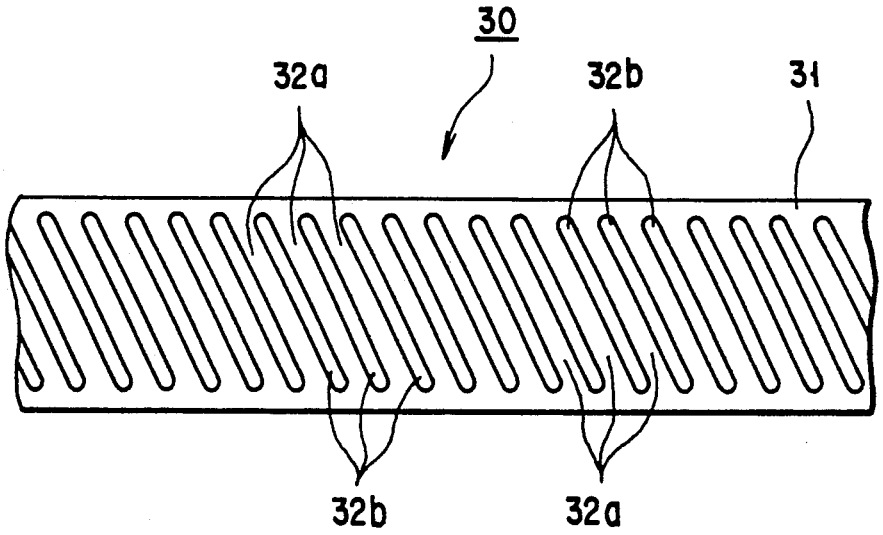
FIG. 7 is a plan view partially showing an arrangement of a recording sheet support plate of the developing head shown in FIG. 6B.

The recording sheet support plate 30 is applied on the upper surface portion of the inner tubular body 22. FIG. 7 is a plan view showing the arrangement of the recording sheet support plate 30. Referring to FIG. 7, a large number of windows **32*b* are formed in a belt-shaped metal plate 31 in the longitudinal direction at a predetermined pitch to form stripes. The windows 32*b* are formed in a direction oblique to a feed direction X of a recording sheet P. The arranging pitch of the windows 32*b* is set to, e.g., 1 to 5 mm, and the angle of the windows 32*b* is set to about 30° to 60° with respect to the feed direction X of the recording sheet P. The depth of the windows 32*b*, that is, the thickness of the metal plate 31 is selected to be about 0.5 mm. The windows 32*b*** may be formed in accordance with, e.g., press punching. Alternatively, they may be formed in accordance with etching or electroforming. Although either method requires an original plate or mold, they easily form a large number of identical products.

The recording sheet support plate 30 formed in this manner is applied to the top portion of the inner tubular body 22, as shown in FIG. 6B, and fixed by bonding or screwing its side portions. Since the recording sheet support plate 30 need to support the recording sheet P by its residual frame portion **32*a*, a material having high wear resistance, e.g., stainless steel, is selected to form the metal plate 31**.

Reference numeral 29 denotes a suction dry groove. The suction dry groove 29 dries the developing surface of the recording sheet P by drawing an extra developing liquid attaching to the recording sheet P. The suction dry groove 29 communicates with a suction pump (not shown).

The developing head having the arrangement as described above performs a developing operation to be described below. More specifically, the recording sheet P is conveyed onto the upper surface of the developing head with its surface formed with an electrostatic latent image facing downward. The suction pump is operated in this state. Then, the interior of the buffer chamber 24 is evacuated to be set at a negative pressure, and the recording sheet P is sucked to the slit-shaped opening portion 26 from which the developing liquid flows out. When the negative pressure near the slit-shaped opening portion 26 is increased, the recording sheet P is sucked to the slit-shaped opening portion 25 into which the developing liquid flows, thus sealing the slit-shaped opening portion 25 with the recording sheet P. At this time, although the recording sheet P is strongly sucked to the slit-shaped opening portions 25 and 26, since the recording sheet support plate 30 is provided to the top portion of the inner tubular body 22, the recording sheet P is uniformly supported by the residual frame portion **32*a* of the recording sheet support plate 30**. Accordingly, the recording sheet P is bent or flexed only slightly.

When the slit-shaped opening portion 25 is sealed, the interior of the buffer chamber 23 into which the developing liquid flows is set at the negative pressure. The developing liquid is drawn from the developing liquid container by the operation of the negative pressure, and the interior of the buffer chamber 23 is filled with the developing liquid. This developing liquid flows to the buffer chamber 24 through the flow paths defined by the windows **32*b*, and then flows from the buffer chamber 24 into the suction pump through the pipe. In other words, a circulating path of the developing liquid is formed. Under this state, when the suction pump continues to be operated while conveying the recording sheet P in the direction indicated by an arrow X, the electrostatic latent image on the recording sheet P is developed with the developing liquid while the recording sheet P passes over the support plate 30 disposed on the inner tubular body 22**.

At this time, the inner tubular body 22 serves as a developing electrode. The function of the developing electrode is enhanced as the gap between the electrode surface and the electrostatic latent image formed surface of the recording sheet P is decreased. However, the flowability of the developing liquid is improved as the gap is widened. An experimentally confirmed preferable gap size was about 0.3 to 1 mm. If the gap is smaller than this, the flow of the developing liquid is interfered with to make it difficult to flow an amount of developing liquid necessary and sufficient for development, and the developing performance is degraded. In contrast to this, if the gap exceeds 1 mm, the function of the developing electrode is weakened.

In this manner, with the developing head of this embodiment, the following effects can be obtained. More specifically, the support plate 30 is fixedly mounted on the slit-shaped opening portion 26 of the outer tubular body 21 and on the inner tubular body 22. A large number of striped windows **32*b* are formed in the support plate 30 at a predetermined pitch to be oblique to the feed direction X of the recording sheet P. Thus, even if the recording sheet P is strongly sucked to the developing portion of the developing head, it is stably supported and conveyed substantially without being bent or flexed. Therefore, the flow paths of the developing liquid formed by the windows 32*b* of the support plate 30 will not clog with the recording sheet P. In addition, the large number of striped windows 32*b* are formed in the support plate 30** to serve as the flow paths of the developing liquid. Therefore, the developing liquid flows substantially linearly and smoothly without causing a turbulence. In other words, the flow path resistance can be minimized. Hence, non-uniformity in development is decreased to enable high-quality development. Since a tension need not be forcibly applied to the recording sheet P, a distortion of or damage to the recording sheet P can be prevented. Also, the recording sheet convey mechanism can be prevented from being increased in size and complicated.

In the developing head of this embodiment, the recording sheet support plate 30 is formed separately from the developing head body 20. When the developing head is to be assembled, the support plate 30 is fixedly mounted on the inner tubular body 22 in the developing head body 20. Hence, the developing head can be formed very easily with high precision when compared to a case in which a developing portion is formed by cutting a partitioning wall. As a result, the manufacturing cost of the developing head is decreased, thus providing a low-cost developing head.

Sixth Embodiment

Figure 8A:
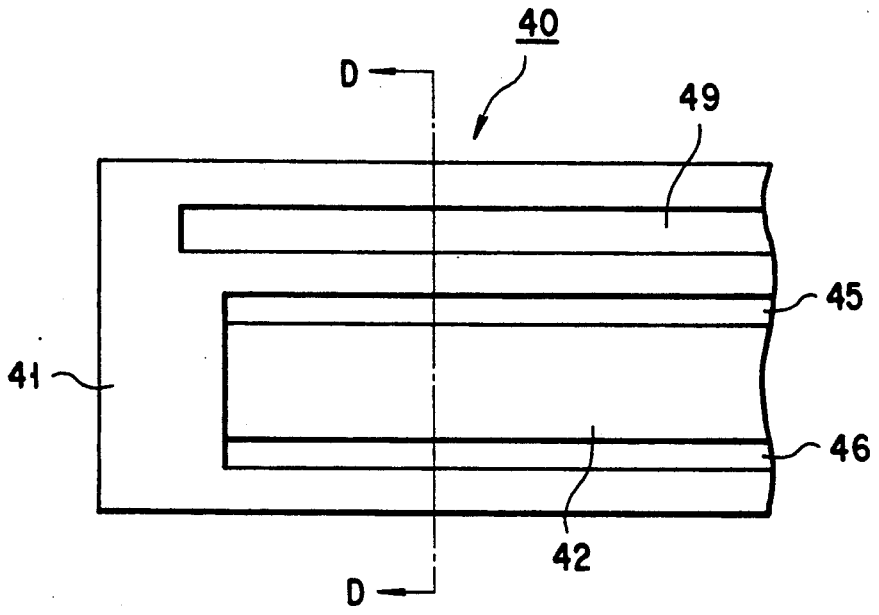
FIGS. 8A and 8B are diagrams showing the main part of an arrangement of a developing head according to the sixth embodiment of the present invention.
Figure 8B:
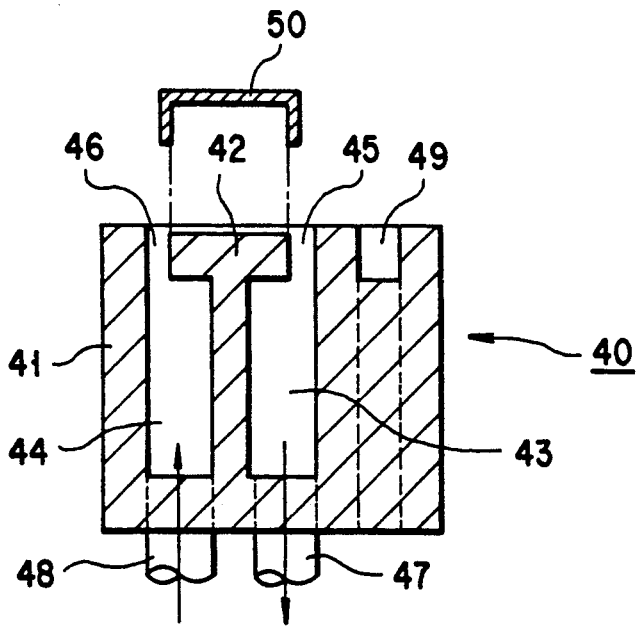

FIGS. 8A and 8B show an arrangement of a developing head according to the sixth embodiment of the present invention, in which FIG. 8A is a partial plan view of the same, and FIG. 8B is a sectional view taken along the line D—D of FIG. 8A.

A developing head body 40 of this embodiment has an outer tubular body 41 having a rectangular section. The hollow portion of the outer tubular body 41 has a slit-shaped opening extending in the longitudinal direction of its upper wall. A partitioning wall 42 having a T-shaped section and forming a ridge is formed in the hollow portion of the outer tubular body 41. The partitioning wall 42 halves the hollow portion in the convey direction X of the recording sheet P. Thus, a buffer chamber 44 into, which the developing liquid flows and a buffer chamber 43 from which the developing liquid flows are defined in the outer tubular body 41. Slit-shaped openings 46 and 45 are defined between the T-shaped top portion of the partitioning wall 42 and the inner wall of the outer tubular body 41. The slit-shaped openings 46 and 45 communicate with the buffer chambers 44 and 43, respectively. The height of the T-shaped top portion of the partitioning wall 42 is set to be smaller than the height of the upper surface of the outer tubular body 41 by at least the thickness of a support plate 50 to be described later. The buffer chamber 44 communicates with a developing liquid outlet port 48. A developing liquid container (not shown) is coupled to the developing liquid inlet port 48 through a pipe. The chamber 43 is coupled to a developing liquid outlet port 47. A suction pump (not shown) coupled to the developing liquid outlet port 47 through a pipe.

Figure 9:
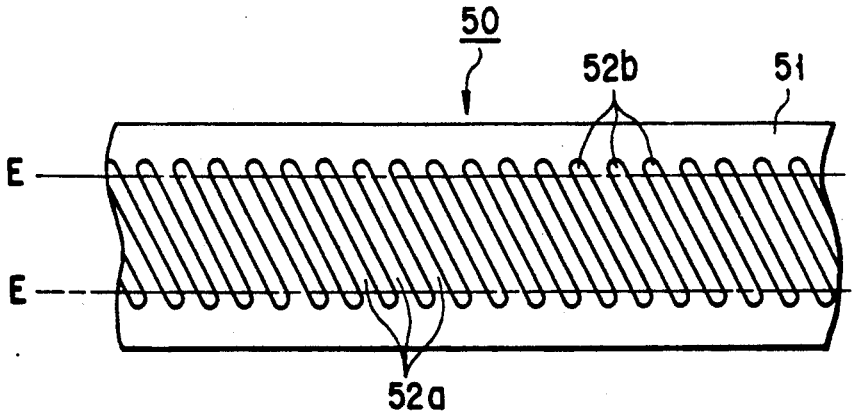
FIG. 9 is a plan view partially showing an arrangement of a recording sheet support plate of the developing head shown in FIG. 8B.

The support plate 50 is fitted on the T-shaped top portion of the partitioning wall 42. FIG. 9 shows an arrangement of the support plate 50. Referring to FIG. 9, a large number of windows **52*b* are formed in a belt-shaped metal plate 51 in the longitudinal direction at a predetermined pitch to form stripes. The windows 52*b* are formed in a direction oblique to the convey direction X of the recording sheet P. The metal plate 51 having the large number of windows 52*b* formed therein is bent at, e.g., a line E and E of FIG. 9 in accordance with press forming. Then, the support plate 50 is formed to have a channel-shaped cross-section. The channel-shaped support plate 50 is fitted on the T-shaped top portion of the partitioning wall 42, as shown in FIG. 8B**, by bonding or screwing.

With this arrangement, even if the recording sheet P is strongly sucked to the partitioning wall 42 of the outer tubular body 41, it is stably supported and conveyed substantially without being bent or flexed. For this reason, the flow paths of the developing liquid defined by the windows **52*b* of the support plate 50 will not clog with the recording sheet P. In addition, the large number of striped windows 52*b* are formed in the support plate 50** to serve as the flow paths of the developing liquid. Thus, the developing liquid flows substantially linearly and smoothly without causing a turbulence. That is, the flow path resistance can be minimized, and high-quality development can be performed without causing non-uniformity.

In the developing head of this embodiment, since the support plate 50 can be formed separately from the developing head body 40 including the partitioning wall 42, the developing head can be manufactured very easily with high precision when compared to a case in which a support plate is formed integrally with the top portion of the partitioning wall 42 itself. As a result, the manufacturing cost of the developing head is decreased, thus providing a low-cost developing head.

In this embodiment, the support plate 50 is bent to have a channel-shaped section, and is fitted on the T-shaped top portion of the partitioning wall 42. Hence, the support plate 50 can be positioned with respect to the partitioning wall 42 easily with high precision.

Figure 10:
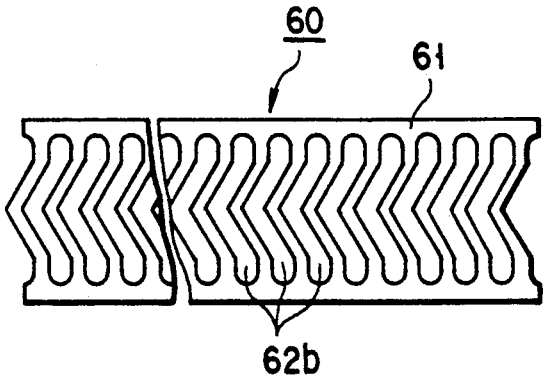
FIG. 10 is a plan view partially showing another arrangement of the recording sheet support plate shown in FIG. 9.
Figure 11:
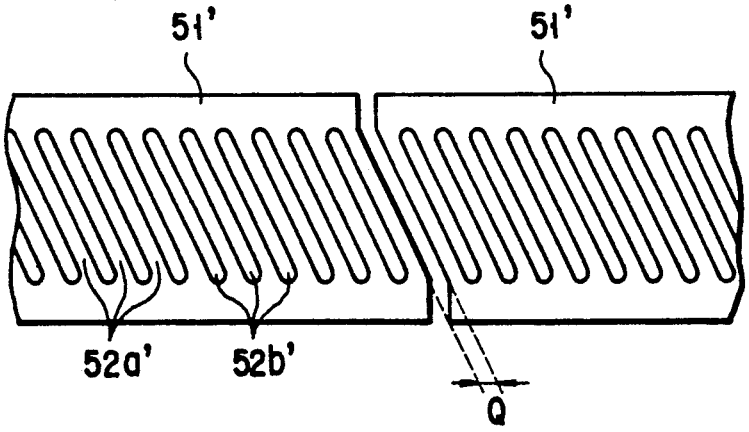
FIG. 11 is a plan view partially showing another arrangement of the recording sheet support plate shown in FIG. 10.

The support plate can be obtained by, e.g., forming a large number of V-shaped windows **62*b* in a metal plate 61, as shown in FIG. 10. If the recording sheet support plate is to be manufactured with a single elongated metal plate, it is sometimes difficult to manufacture it depending on the length. Thus, the support plate may be manufactured in the following manner. That is, as shown in FIG. 11, a plurality of short metal plates 51' are prepared. A large number of striped windows 52*b'* are formed in each metal plate 51'. Each metal plate 51' having the large of windows 52*b'* formed therein is bent to have a channel-shaped section. The resultant metal plates 51' are arranged and fixed on the top portion of the partitioning wall 42 at a predetermined gap Q. At this time, the gap Q is set to be equal to the width of each window 52*b'*. The value of the width Q of each window 52*b'* is preferably set to, e.g., 1 to 3 mm. When this method of manufacturing the support plate is employed, the windows 52*b'* may be formed in each short metal plate 51', and the metal plates 51' may be bent. Thus, the mold for forming the support plate, the machining unit, and the like can be small. When etching or electroforming is performed, non-uniformity in the process can be minimized. Hence, the metal plates 51'** can be efficiently processed with a small, simple processing equipment while preventing defects.

Figure 12:
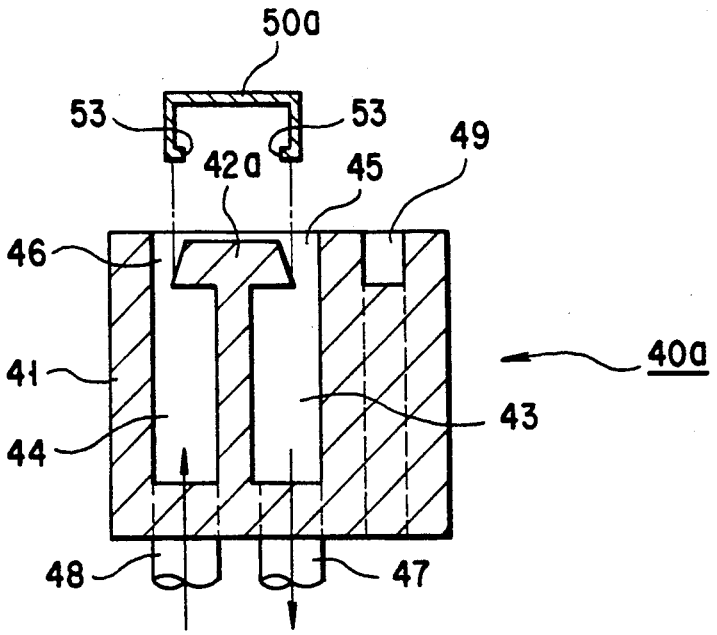
FIG. 12 is a sectional view showing another arrangement of the developing head shown in FIG. 8B.

The support plate can be mounted on the developing head body in various other manners as follows. In the example shown in FIG. 12, the two distal end portions of a support plate **50*a* having a channel-shaped section are bent inward, thereby forming engaging pawls 53 at the two distal end portions of the support plate 50*a*. The engaging pawls 53 are engaged with the lower side portions of the T-shaped top portion of a partitioning wall 42*a* when the support plate 50*a* is fitted on the T-shaped top portion of the partitioning wall 42*a***.

Figure 13:
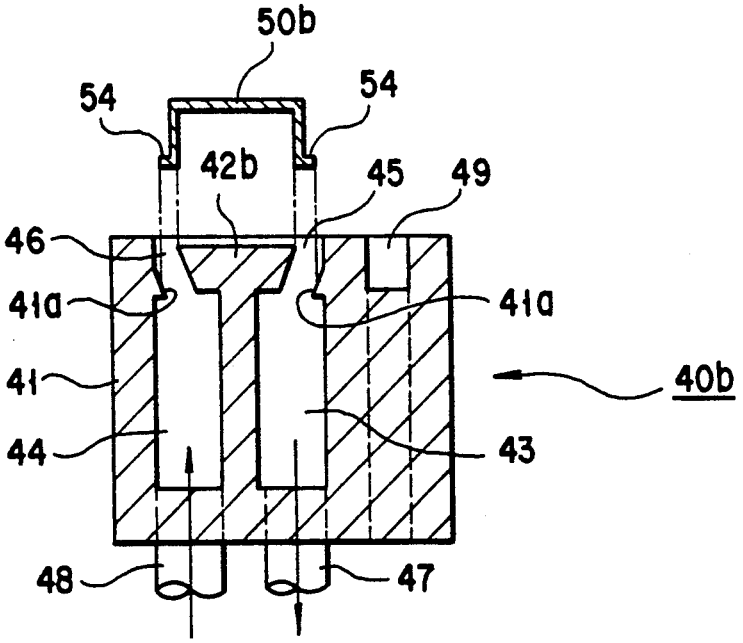
FIG. 13 is a sectional view showing still another arrangement of the developing head shown in FIG. 8B.

In the example shown in FIG. 13, the two distal end portions of a support plate **50*b* having a channel-shaped section are bent outward, thereby forming engaging pawls 54 at the two distal end portions of the support plate 50*b*. A corresponding pair of projecting portions 41*a* are formed on the inner surface of an outer tubular body 41. When the support plate 50*b* is fitted on the T-shaped top portion of a partitioning wall 42*b*, the engaging pawls 54 are engaged with the pair of projecting portions 41*a* on the inner surface of the outer tubular body 41**.

Figure 14:
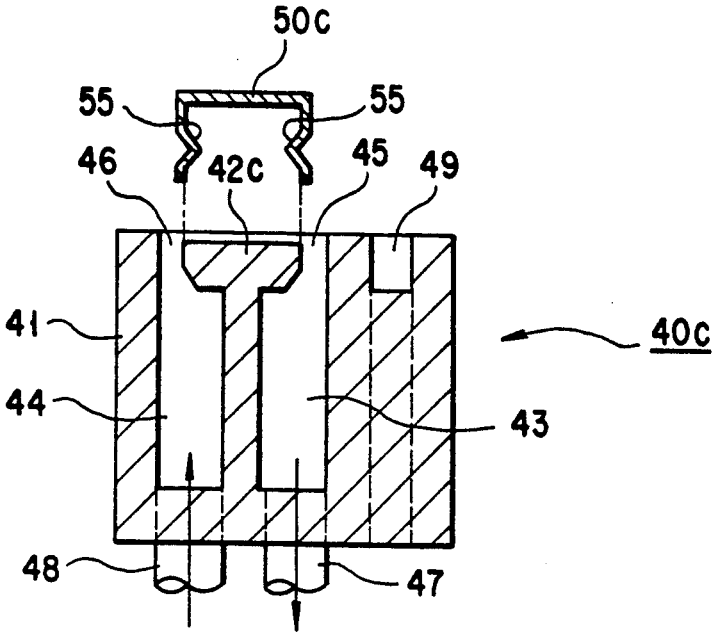
FIG. 14 is a sectional view showing still another arrangement of the developing head shown in FIG. 8B.

In the example shown in FIG. 14, a pair of inwardly bent V-shaped projecting portions 55 are formed at the intermediate portions of two bent end pieces, respectively, of a support plate **50*c*. The corresponding lower side edges of the T-shaped top portion of a partitioning wall 42*c* are removed. When the support plate 50*c* is mounted on the T-shaped top portion of the partitioning wall 42*c*, the pair of projecting portions 55 of the support plate 50*c* are engaged with portions of the T-shaped top portion of the partitioning wall 42*c*** where the edges are removed.

Figure 15:
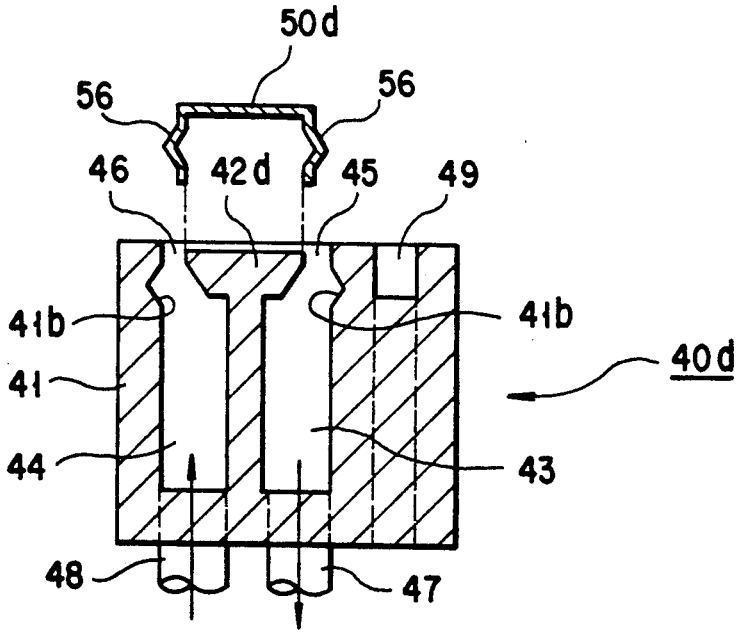
FIG. 15 is a sectional view showing still another arrangement of the developing head shown in FIG. 8B.

In the example shown in FIG. 15, a pair of outwardly protruding V-shaped projecting portions 56 are formed at intermediate portions of two bent end pieces of a support plate **50*d*. A corresponding pair of recessed portions 41*b* are formed on the inner surface of an outer tubular body 41. When the support plate 50*d* is mounted on the T-shaped top portion of a partitioning wall 42*d*, the pair of projecting portions 56 are engaged with the pair of recessed portions 41*b* in the inner surface of the outer tubular body 41**.

With the above arrangement, the support plate is detachably mounted on the developing head body. Accordingly, the support plate can be replaced as required or periodically. As a result, the support plate can be formed of a material having high workability but low wear resistance, and can be replaced according to its wearing degree.

Seventh Embodiment

Figure 16A:
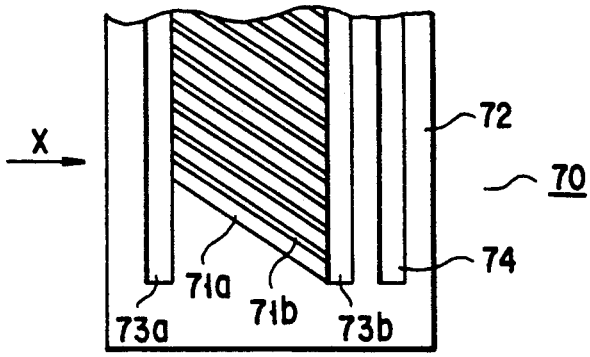
FIGS. 16A and 16B are diagrams schematically showing an arrangement of a liquid-type developing apparatus according to the seventh embodiment of the present invention.
Figure 16B:
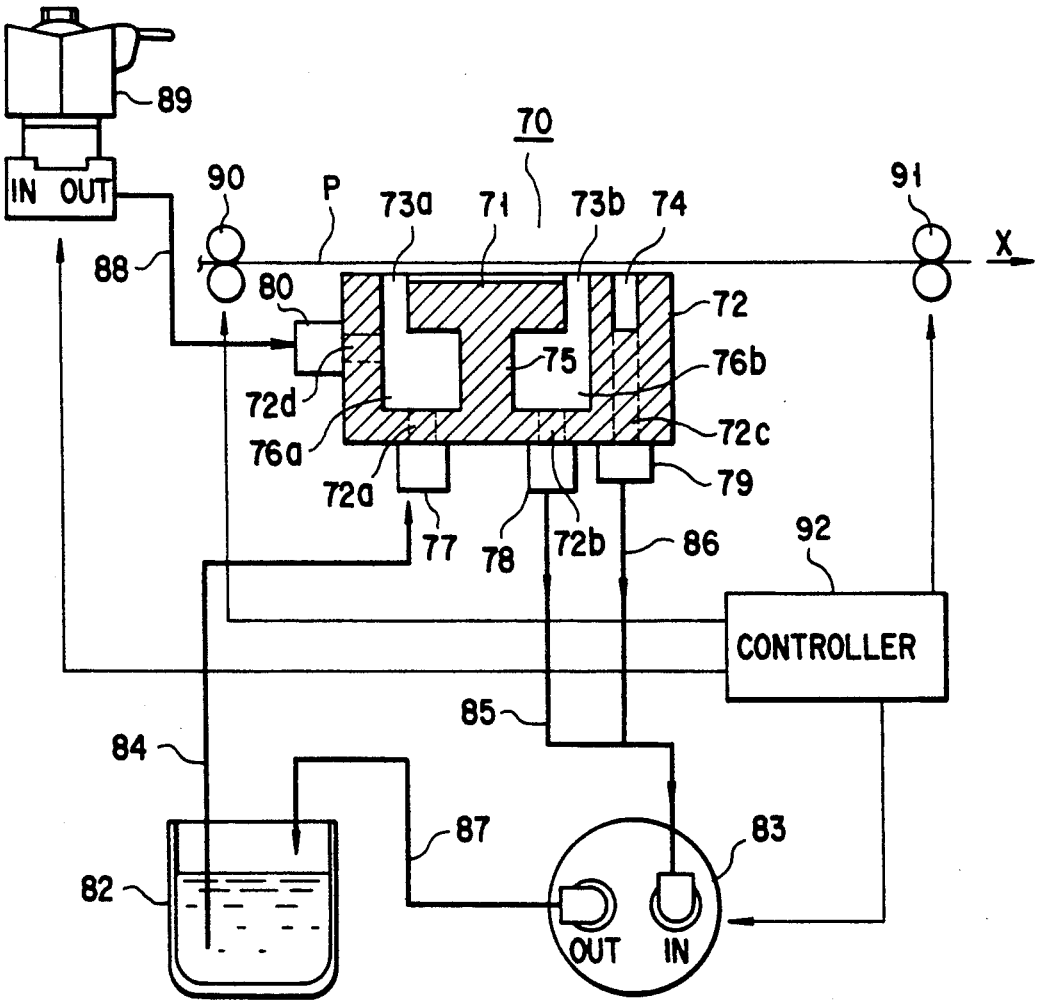

FIGS. 16A and 16B show an arrangement of a liquid-type developing apparatus according to the seventh embodiment of the present invention, in which FIG. 16A is a partial plan view showing the structure of a developing portion of a developing head, and FIG. 16B schematically shows the arrangement of the developing apparatus together with the sectional view of the developing head.

A developing head 70 has a rectangular parallelepiped base body 72 having a hollow portion. Two slit-shaped openings **73*a* and 73*b* and a groove 74 are formed in the upper surface of the base body 72 in the longitudinal direction to be parallel to each other. The hollow portion of the base body 72 is partitioned by a partitioning wall 71 having a T-shaped section, thus defining a buffer chamber 76*a* into which a developing liquid flows and a buffer chamber 76*b* from which the developing liquid flows out. The groove 74 is independent of the buffer chambers 76*a* and 76*b*. A channel path 72*a* is formed in the bottom surface of the buffer chamber 76*a*, and a developing liquid inlet port 77 is formed in the channel path 72*a*. The developing liquid inlet port 77 communicates with a developing liquid container 82 through a pipe 84. A channel path 72*b* is formed in the bottom surface of the buffer chamber 76*b*, and a developing liquid outlet port 78 is formed in the channel path 72*b*. The developing liquid outlet port 78 is connected to the inlet port (IN) of a suction pump 83 through a pipe 85. A channel path 72*c* is formed in the bottom surface of the groove 74, and an exhaust port 79 is formed in the channel path 72*c*. The exhaust port 79 is connected to the inlet port (IN) of the suction pump 83 through a pipe 86. The outlet port (OUT) of the suction pump 83 communicates with a developing liquid container 82 through a pipe 87**.

A plurality of grooves **71*a* are formed in the top portion of the partitioning wall 71 to obliquely cross from the slit-shaped openings 73*a* and 73*b* at a predetermined pitch. The grooves 71*a* form the flow paths of the developing liquid. Residual projecting portions 71*b* between the grooves 71*a* constitute a recording sheet support portion. That is, the crest surface of the partitioning wall 71 formed with the grooves 71*a* and the residual projecting portions 71*b* and the slit-shaped openings 73*a* and 73*b*** constitute the developing portion for the recording sheet P.

A channel path 72*d* is formed in the side surface of the buffer chamber 76*a* into which the developing liquid flows, and an outer air inlet port 80 is formed in the channel path 72*d*. The outer air inlet port 80 is connected to the outlet port (OUT) of an outer air relief valve 89 through a pipe 88. The inlet port (IN) of the outer air relief valve 89 is exposed to the outer air.

Convey rollers 90 and 91 convey the recording sheet P, and a controller 92 serves as the control center of this apparatus. Convey control of the recording sheet P, drive control of the suction pump 83, opening/closing control of the outer air relief valve 89, and the like are performed by the controller 92.

The operation of the liquid-type developing apparatus having the arrangement as described above will be described. The controller 92 rotates the convey rollers 90 and 91 to convey the recording sheet P in a direction indicated by an arrow X, thereby feeding the recording sheet P to a portion above the developing head 70. The outer air relief valve 89 is kept closed, and the suction pump 83 is actuated. Then, air in the buffer chamber 76*b* from which the developing liquid flows out and air in the buffer chamber 76*a* into which the developing liquid flows are drawn by the drawing function of the suction pump 83. At this time, the slit-shaped openings 73*b* and 73*a* are hermetically closed by the recording sheet P. Thus, the interiors of the buffer chambers 76*a* and 76*b* are set at a negative pressure one after another. As a result, the developing liquid in the developing liquid container 82 is drawn into the buffer chamber 76*a* through the developing liquid inlet port 77 and the pipe 84. When the buffer chamber 76*a* is filled with the developing liquid, the developing liquid flows in the buffer chamber 76*b* through the groove 71*a*. The developing liquid flows from the buffer chamber 76*b* into the inlet port (IN) of the suction pump 83 through the pipe 85. Then, the developing liquid flows from the outlet port (OUT) of the suction pump 83 into the developing liquid container 82 through the pipe 87. The circulating path of the developing liquid is thus formed.

In this state, when the recording sheet P is conveyed, the recording sheet P is brought into contact with the developing liquid at the developing portion of the developing head 70 to develop the electrostatic latent image. The recording sheet P having the developed image thereon is conveyed to the suction dry groove 74 with the developing liquid attaching to its surface. The developing liquid attaching to the surface of the recording sheet P is removed by suction at the suction dry groove 74. The electrostatic latent image of the recording sheet P is thus developed.

When development of the electrostatic latent image formed on the recording sheet P is completed, the controller 92 stops conveyance of the recording sheet P. Then, the controller 92 opens the outer air relief valve 89 while the recording sheet P is stopped. At this time, the controller 92 keeps the suction pump 83 operative. Accordingly, the interior of the buffer chamber 76*a* is at the negative pressure, and when the outer air relief valve 89 is opened, air flows into the buffer chamber 76*a* from the inlet port (IN) of the outer air relief valve 89. This air flows from the outlet port (OUT) of the outer air relief valve 89 into the buffer chamber 76*a* through the pipe 88 and the outer air inlet port 80. The outer air inlet port 80 is formed at, e.g., the highest portion of the buffer chamber 76*a*. Hence, when air flows into the buffer chamber 76*a*, the negative pressure in the buffer chamber 76*a* is decreased, and the force for drawing up the developing liquid from the developing liquid container 82 to the buffer chamber 76*a* is decreased. Since the developing liquid container 82 is located lower than the buffer chamber 76*a*, when the force of drawing up the developing liquid from the developing liquid container 82 to the buffer chamber 76*a* is decreased in this manner, the developing liquid in the buffer chamber 76*a* freely drops because of its own potential energy to be recovered in the developing liquid container 82.

Air flowed into the buffer chamber 76*a* flows to the buffer chamber 76*b* through the slit-shaped openings 73*a* and 73*b* and the grooves 71*a* on the partitioning wall 71 because of the drawing function of the suction pump 83. The developing liquid is pushed out from the slit-shaped openings 73*a* and 73*b*, the grooves 71*a*, and the buffer chamber 76*b* by this air flow to be recovered in the developing liquid container 82 through the suction pump 83.

Thus, when the outer air relief valve 89 is opened, the liquid level of the developing liquid filled in the buffer chambers 76*a* and 76*b* is quickly decreased simultaneously. The developing liquid in the slit-shaped openings 73*a* and 73*b* and the grooves 71*a* is removed by the drawing function of the suction pump 83.

In this state, the developing liquid is no longer newly supplied to the surface of the recording sheet P. However, the developing liquid attaching to the recording sheet P still remains. The remaining developing liquid is conveyed to the suction dry groove 74 and removed by suction by conveying again the recording sheet P which has been stopped, or by opening the outer air relief valve 89 while conveying the recording sheet P. When the developing liquid remaining on the recording sheet P is removed in this manner, there will be no longer the developing liquid to wet the recording sheet P, and the controller 92 stops the operation of the suction pump 83, thereby completing development.

As has been described above, according to this embodiment, while the outer air relief valve 89 is open, air is directly drawn into the buffer chamber 76*a*. Thus, the negative pressure in the buffer chamber 76*a* is decreased in this state, and a force for drawing up the developing liquid in the developing liquid container 82 is not generated. Accordingly, while the outer air relief valve 89 is open, the developing liquid is not supplied to the developing head 70. The developing liquid fully contained in the buffer chambers 76*a* and 76*b*, the slit-shaped openings 73*a* and 73*b*, and the grooves 71*a* is recovered in the developing liquid container 82 through the pipe 84 or 85, the suction pump 83, and the pipe 87. As a result, removal of the developing liquid from the developing head 70 is efficiently performed, and the time required for removing the developing liquid is shortened.

In addition, according to this embodiment, the developing liquid fully contained in the buffer chamber 76*a* is recovered in the developing liquid container 82 through the pipe 84 by the potential energy as the air is supplied through the open outer air relief valve 89. The developing liquid fully contained in the slit-shaped openings 73*a* and 73*b*, the grooves 71*a* and the buffer chamber 76*b* is pushed out by air flowing into the buffer chamber 76*a* through the open outer air relief valve 89 and recovered in the developing liquid container 82 through the pipe 85, the suction pump 83, and the pipe 87. That is, removal of the developing liquid from the developing head 70 is performed at two paths in the parallel manner. Removal of the developing liquid from the developing head 70 is quickly performed from this point of view as well.

Eighth Embodiment

The eighth embodiment of the present invention will be described.

Figure 17:
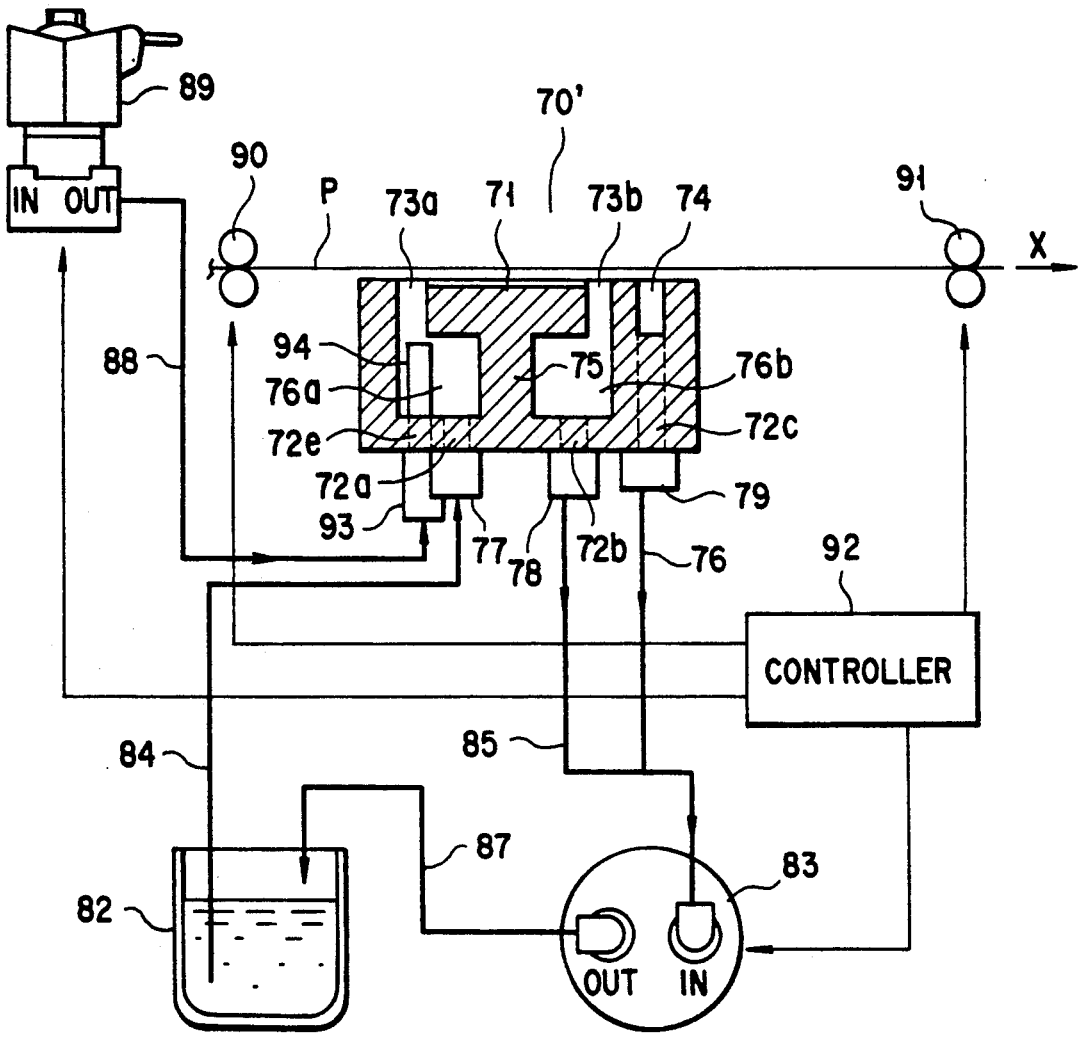
FIG. 17 is a diagram schematically showing an arrangement of a liquid-type developing apparatus according to the eighth embodiment of the present invention.

FIG. 17 schematically shows an arrangement of a liquid-type developing apparatus according to this embodiment. In FIG. 17, the same portions as in FIG. 16B described above are denoted by the same reference numerals, and a detailed description thereof will be omitted.

Although the liquid-type developing apparatus according to the eighth embodiment has basically the same arrangement as that of the first embodiment, its outer air inlet port is different. More specifically, in addition to a channel path 72*a* into which the developing liquid flows, an outer air inlet path 72*e* is formed in the bottom portion of a buffer chamber 76*a* into which the developing liquid flows. An outer air inlet port 93 is formed in the inlet portion of the outer air inlet path 72*e*. The outer air inlet port 93 is formed in the outlet port (OUT) of an outer air relief valve 89 through a pipe 88. An outer air inlet pipe 94 is formed in the outlet portion of the buffer chamber 76*a*. The open end of the outer air inlet pipe 94 is located at the highest portion of the buffer chamber 76*a*.

The completely same effect as that of the seventh embodiment can be obtained with this arrangement of the eighth embodiment as well. According to the eighth embodiment, the pipes to a developing head 70′ can be concentratedly installed on the bottom portion of the developing head 70′. Thus, the size and arrangement of the apparatus are increased and simplified.

Ninth Embodiment

The ninth embodiment of the present invention will be described.

In the seventh and eighth embodiments, a large amount of air may flow into the buffer chamber 76*a* through the outer air relief valve 89. When, however, the amount of air flowing into the buffer chamber 76*a* is excessively large, the negative pressure in the developing head 70 or 70′ is excessively decreased, and the recording sheet P is not sometimes sucked to the developing head 70 or 70′. Also the suction dry effect at the suction dry groove 74 is degraded to incompletely dry the recording sheet P, and the non-dried recording sheet P may be conveyed to contaminate the copying machine.

Figure 18:
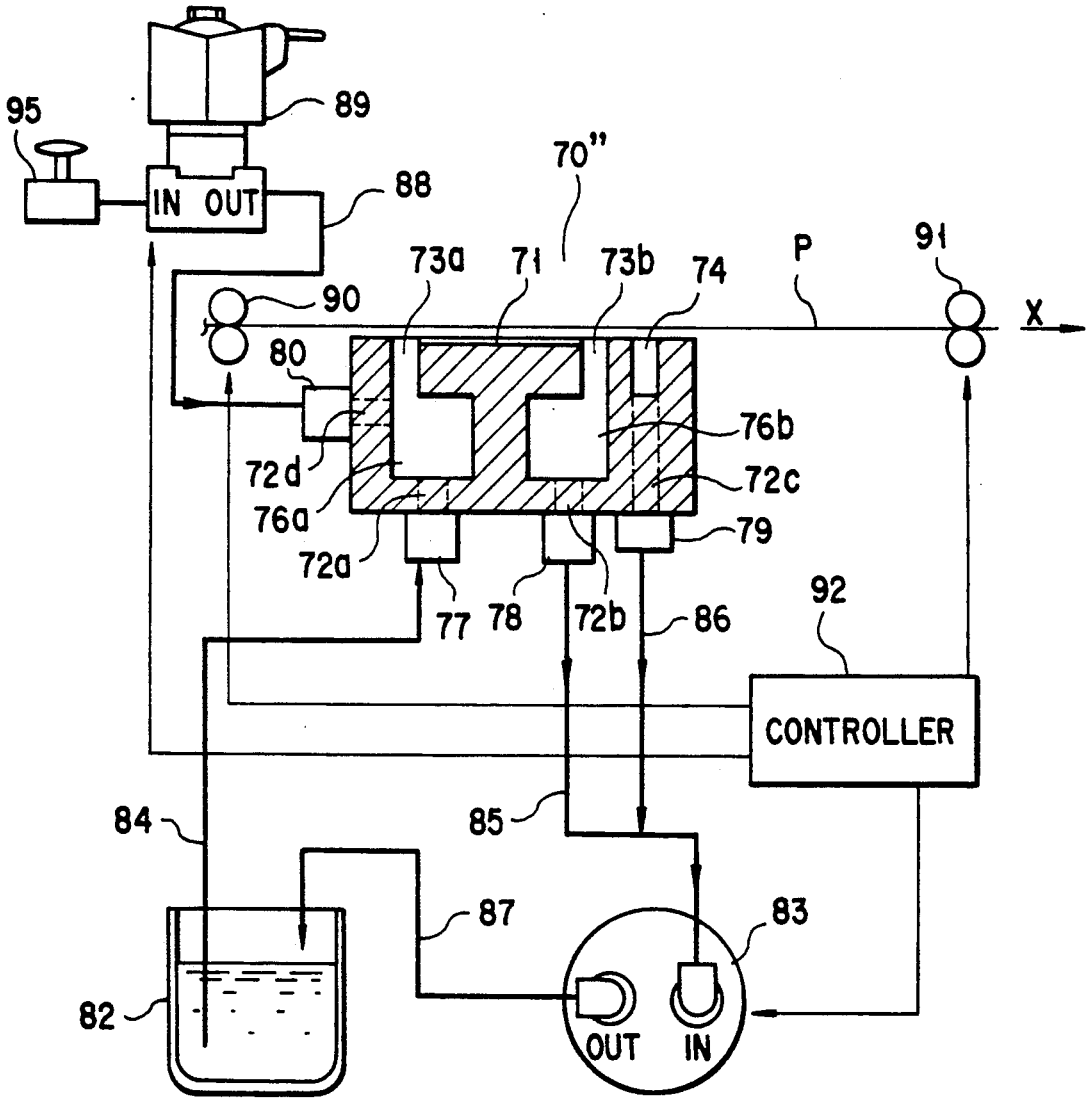
FIG. 18 is a diagram schematically showing an arrangement of a liquid-type developing apparatus according to the ninth embodiment of the present invention.
Figure 19:
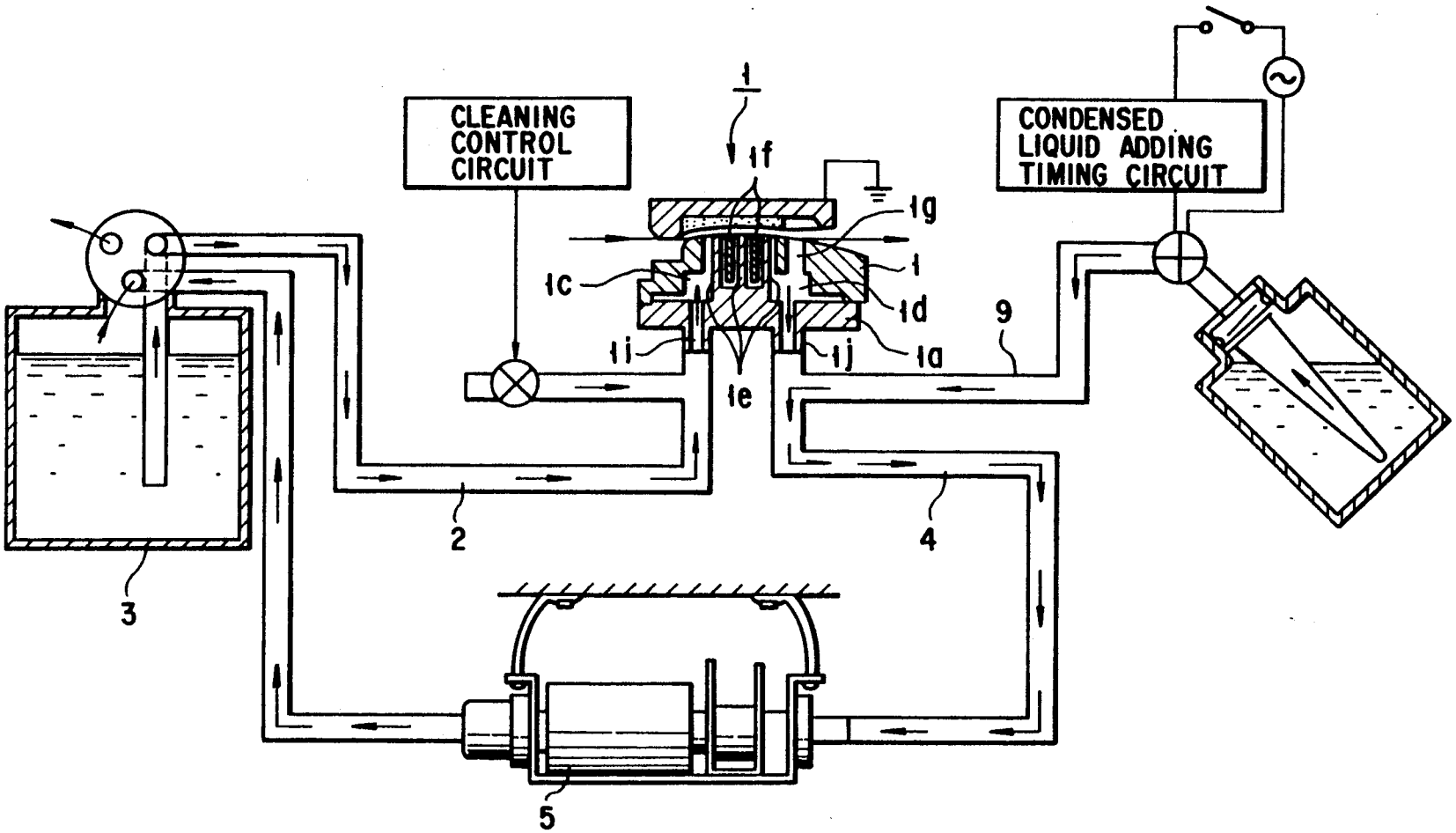
PRIOR ART FIG. 19
FIG. 19 is a diagram showing an arrangement of a conventional liquid-type developing apparatus.
Figure 20:
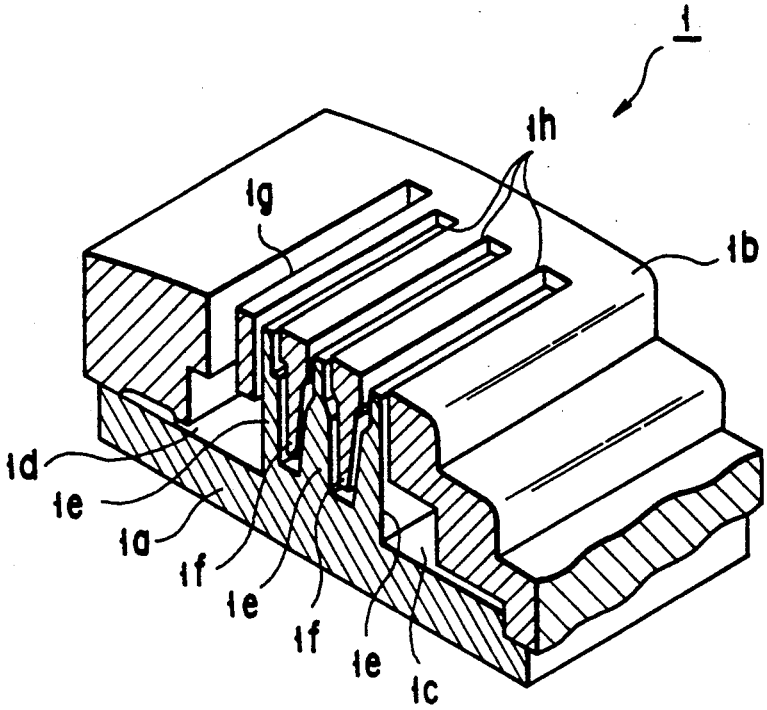
PRIOR ART FIG. 20
FIG. 20 is an enlarged sectional view showing the liquid-type developing apparatus shown in FIG. 19.
Figure 21:
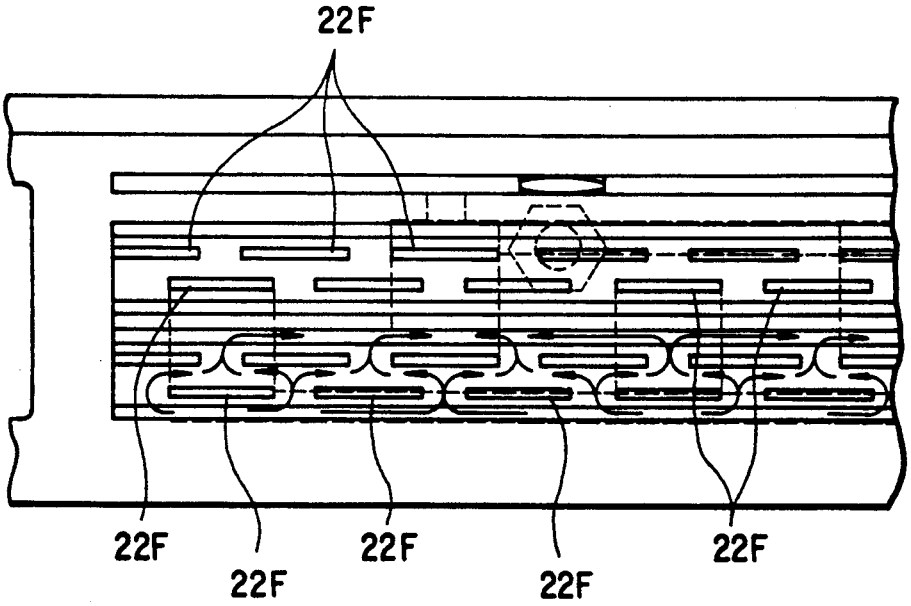
PRIOR ART FIG. 21
FIG. 21 is a diagram partially showing an arrangement of another conventional developing head.

These drawbacks can be avoided by the arrangement of the ninth embodiment. FIG. 18 schematically shows an arrangement of a liquid-type developing apparatus according to the ninth embodiment. Referring to FIG. 18, the same portions as in FIG. 16 are denoted by the same reference numerals, and a detailed description thereof will be omitted.

In the liquid-type developing apparatus of this embodiment, a flow control valve 95 for controlling the flow amount of air is provided to the inlet port (IN) of an outer air relief valve 89. The flow control valve 95 has a limited flow path diameter to be open to the outer air, and sets the pressure in a developing head 70″ to about −70 mmHg to a negative value of about −30 mmHg. With this arrangement, when the flow amount of air to the outer air relief valve 89 is controlled at an appropriate value by the flow control valve 95, air will not flow into a buffer chamber 76*a* more than necessary, avoiding the drawbacks described above.

The seventh to ninth embodiments described above can be modified in various manners as follows. For example, in the above embodiments, the open portion of the outer air inlet port 80 or 93 is located at the highest portion of the buffer chamber 76*a*. However, the open portion of the outer air inlet port 80 or 93 may be set at an arbitrary portion as far as it is in the hollow portion of the developing head 70 or 70′.

In each of the above embodiments, the hollow portion of the developing head 70, 70′, or 70″ is divided into the buffer chambers 76*a* and 76*b* and the slit-shaped openings 73*a* and 73*b*. However, the developing head 70 70′, or 70″ can have any structure as far as it has a hollow portion.

The ninth embodiment exemplifies a case wherein the flow control valve 95 is provided. The flow control valve 95 is effective in experimentally determining the flow rate. When, however, the appropriate flow rate is known, the flow control valve 95 can be omitted. Thus, when the appropriate flow rate is known, a simple restrictor opening may be formed in place of the flow control valve. Then, the apparatus can be simplified and manufactured at a low cost. When the orifice diameter of the outer air relief valve applies to the optimum flow rate, not only the flow control valve but also the restrictor opening are not needed. For example, when a developing head having an effective developing width of about 80 cm employs a vane pump having a displacement of 4 l/min., the appropriate diameter of the opening to the outer air is 1 mm to several mm.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A liquid-type developing apparatus comprising:

a developing head having a developing portion;

a developing liquid container for containing a developing liquid;

a suction pump;

a pipe for connecting said developing head, said developing liquid container, and said suction pump in a loop manner, and for circulating the developing liquid in said developing liquid container through said developing head in accordance with a drawing function of said suction pump; and sheet convey means for conveying a recording sheet on which an electrostatic latent image is formed while the recording sheet opposes said developing portion of said developing head, wherein said developing head comprises a hollow portion having a slit-shaped opening portion having as a longitudinal direction a direction perpendicular to a convey direction of the recording sheet, and a partitioning wall for dividing said hollow portion into developing liquid flow-in and flow-out chambers and having a top portion located at said slit-shaped opening portion, and a plurality of projecting portions and recessed portions comprising said developing portion are formed on said top portion of said partitioning wall, said plurality of projecting portions and recessed portions are alternately disposed at a predetermined pitch to form stripes in the longitudinal direction of said slit-shaped opening portion, said stripes are formed in a direction oblique to the convey direction of the recording sheet, a height of said projecting portions is set to be equal to that of said slit-shaped opening portion, and a height of said recessed portions is set to be lower than that of said slit-shaped opening portion.

2. An apparatus according to claim 1, wherein a plurality of rows of striped projecting/recessed portions comprising said plurality of projecting portions and said plurality of recessed portions are formed at said top portion of said partitioning wall in the convey direction of the recording sheet.

3. An apparatus according to claim 2, wherein directions of said stripes of said plurality of rows of striped projecting/recessed portions are alternately different in units of rows.

4. An apparatus according to claim 2, wherein said plurality of rows of striped projecting/recessed portions are arranged such that positions of said plurality of projecting portions and positions of said plurality of recessed portions are offset from each other in the longitudinal direction of said slit-shaped opening portion.

5. A liquid-type developing apparatus comprising:

a developing head having a developing portion;

a developing liquid container for containing a developing liquid;

a suction pump; and a pipe for connecting said developing head, said developing liquid container, and said suction pump in a loop manner, and for circulating the developing liquid in said developing liquid container through said developing head in accordance with a drawing function of said suction pump; and sheet convey means for conveying a recording sheet on which an electrostatic latent image is formed while the recording sheet opposes said developing portion of said developing head, wherein said developing head comprises a hollow portion having a slit-shaped opening portion having as a longitudinal direction a direction perpendicular to a convey direction of the recording sheet, a partitioning wall for dividing said hollow portion into developing liquid flow-in and flow-out chambers and having a top portion located at said slit-shaped opening portion, and a belt-shaped plate member, disposed at said slit-shaped opening portion including at least said top portion of said partitioning wall, for constituting said developing portion, and said belt-shaped plate member has a plurality of windows disposed at a predetermined pitch to form stripes in the longitudinal direction of said slit-shaped opening portion such that a direction of said stripes is set oblique to the convey direction of the recording sheet.

6. An apparatus according to claim 5, wherein said belt-shaped plate member comprises the plurality of windows and is bent to have a channel-shaped cross-section, and said channel-shaped belt-shaped plate member is placed at said top portion of said partitioning wall.

7. An apparatus according to claim 6, wherein said belt-shaped plate member comprises an elastic member and has engaging portions to be engaged with side wall portions of said partitioning wall, said engaging portions being formed on a pair of bent end pieces obtained by bending said belt-shaped plate member in a channel-shaped manner.

8. An apparatus according to claim 7, wherein engagement receiving portions to be engaged with said engaging portions of said belt-shaped plate member are formed on said side wall portions of said partitioning wall.

9. An apparatus according to claim 5, wherein a plurality of rows of windows are formed in said belt-shaped plate member in the convey direction of the recording sheet.

10. An apparatus according to claim 5, wherein said belt-shaped plate member comprises a plurality of belt-shaped plate pieces connected together, each plate piece being shorter than a length of said slit-shaped opening portion in the longitudinal direction of said slit-shaped opening portion.

11. A liquid-type developing apparatus comprising:

a developing head incorporating developing liquid flow-in and flow-out chambers and having a slit-shaped opening portion communicating between said developing liquid flow-in and flow-out chambers;

a developing liquid container communicating with said developing liquid flow-in chamber of said developing head through a developing liquid supply pipe;

a suction pump, communicating with said developing liquid flow-out chamber of said developing head through a pipe, for causing said developing liquid flow-in chamber of said developing head to communicate with said developing liquid flow-out chamber of said developing head through said slit-shaped opening portion to supply the developing liquid contained in said developing liquid container therebetween;

sheet convey means for conveying a recording sheet on which an electrostatic latent image is formed while the recording sheet opposes said slit-shaped opening portion of said developing head;

outer air inlet path means, connected directly to said developing liquid flow-in chamber of said developing head, for supplying air to said developing liquid flow-in chamber independent of said developing liquid supply pipe;

outer air valve means, located in said outer air inlet path means, for communicating with said developing liquid flow-in chamber through said outer air inlet path means; and control means for performing control to at least open said outer air valve means at a final step of development on the recording sheet.

12. An apparatus according to claim 11, wherein an outer air inlet resistance of said outer air inlet path means including said outer air valve means is set such that interiors of said developing liquid flow-in and flow-out chambers of said developing head are set at a negative pressure while said suction pump is operative and said outer air valve means is open.

13. An apparatus according to claim 11, wherein said outer air inlet path means including said outer air valve means has flow control means for controlling a flow rate of outer air supplied to said developing liquid flow-in chamber.

14. An apparatus according to claim 6, wherein a plurality of rows of windows are formed in said belt-shaped plate member in the convey direction of the recording sheet.

15. An apparatus according to claim 7, wherein a plurality of rows of windows are formed in said belt-shaped plate member in the convey direction of the recording sheet.

16. An apparatus according to claim 6, wherein said belt-shaped plate member comprises a plurality of belt-shaped plate pieces connected together, each plate piece being shorter than a length of said slit-shaped opening portion in the longitudinal direction of said slit-shaped opening portion.

17. An apparatus according to claim 7, wherein said belt-shaped plate member comprises a plurality of belt-shaped plate pieces connected together, each plate piece being shorter than a length of said slit-shaped opening portion in the longitudinal direction of said slit-shaped opening portion.

* * * * *